US008397761B2

(12) United States Patent
Johannessen

(10) Patent No.: US 8,397,761 B2
(45) Date of Patent: Mar. 19, 2013

(54) VORTEX BRAKE FOR A LIQUID DRAINAGE SYSTEM

(75) Inventor: Jorgen Mosbaek Johannessen, Koge (DK)

(73) Assignee: Mosbaek A/S, Koge (DK)

( * ) Notice: Subject to any disclaimer, the term of this patent is extended or adjusted under 35 U.S.C. 154(b) by 1226 days.

(21) Appl. No.: 11/813,269

(22) PCT Filed: Jun. 13, 2005

(86) PCT No.: PCT/DK2005/000385

§ 371 (c)(1),
(2), (4) Date: Jul. 2, 2007

(87) PCT Pub. No.: WO2006/069574

PCT Pub. Date: Jul. 6, 2006

(65) Prior Publication Data

US 2008/0105314 A1 May 8, 2008

(30) Foreign Application Priority Data

Dec. 30, 2004 (DK) ..... PA 2004 02035

(51) Int. Cl.
*F15C 1/16* (2006.01)

(52) U.S. Cl. ..... 137/810; 137/813

(58) Field of Classification Search ..... 137/803, 137/808, 810, 812, 813; 405/40; 404/2, 404/4

See application file for complete search history.

(56) References Cited

U.S. PATENT DOCUMENTS

| | | | | |
|---|---|---|---|---|
| 3,215,165 | A | 11/1965 | Boadway | |
| 4,002,055 | A * | 1/1977 | Kops | 73/40 |
| 4,206,783 | A * | 6/1980 | Brombach | 137/810 |
| 4,679,595 | A * | 7/1987 | Johannessen | 137/813 |
| 5,052,442 | A | 10/1991 | Johannessen | |
| 5,080,137 | A | 1/1992 | Adams | |
| 5,303,782 | A * | 4/1994 | Johannessen | 137/809 |
| 5,640,988 | A | 6/1997 | Brereton | |
| 6,053,206 | A | 4/2000 | Johannesen | |
| 6,082,925 | A | 7/2000 | Raasch | |
| 6,164,869 | A | 12/2000 | Guthler et al. | |
| 6,406,216 | B1 | 6/2002 | Raasch | |

FOREIGN PATENT DOCUMENTS

| | | |
|---|---|---|
| GB | 2254938 A | 10/1992 |
| GB | 2267976 A | 12/1993 |

* cited by examiner

*Primary Examiner* — Craig Schneider
(74) *Attorney, Agent, or Firm* — Browdy and Neimark, P.L.L.C.

(57) ABSTRACT

A vortex brake (4) for a liquid drainage system has a vortex chamber (5), an inlet section (6) and an outlet (12), wherein liquid can flow into the inlet section (6), through this into the vortex chamber (5), through this and out through the outlet (12). The vortex chamber (5) has a side wall (9), following a conical face, and a base wall (11). The conical face has a cone axis (10), and the outlet (12) is located at an apex of the conical face. The inlet section (6) has side walls (14) and a bottom wall (15) that extend mutually in parallel in a direction of flow (16) in the inlet section (6), and a ceiling. Said ceiling having a converging ceiling portion, which extends between a first and a second end of the ceiling portion, and which, in said direction of flow, extends converging towards the bottom wall (15).

26 Claims, 8 Drawing Sheets

Figure 1:
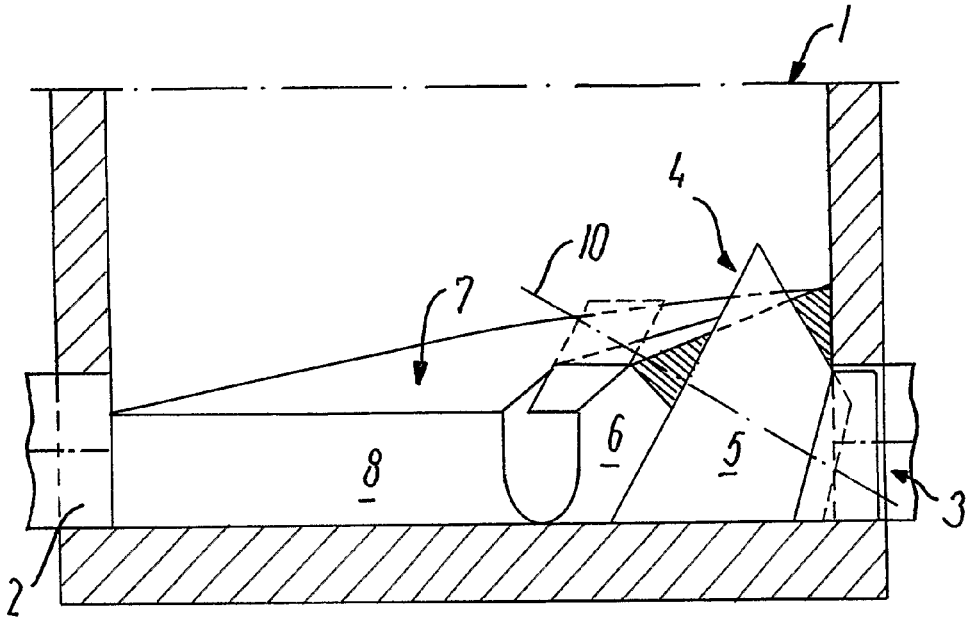

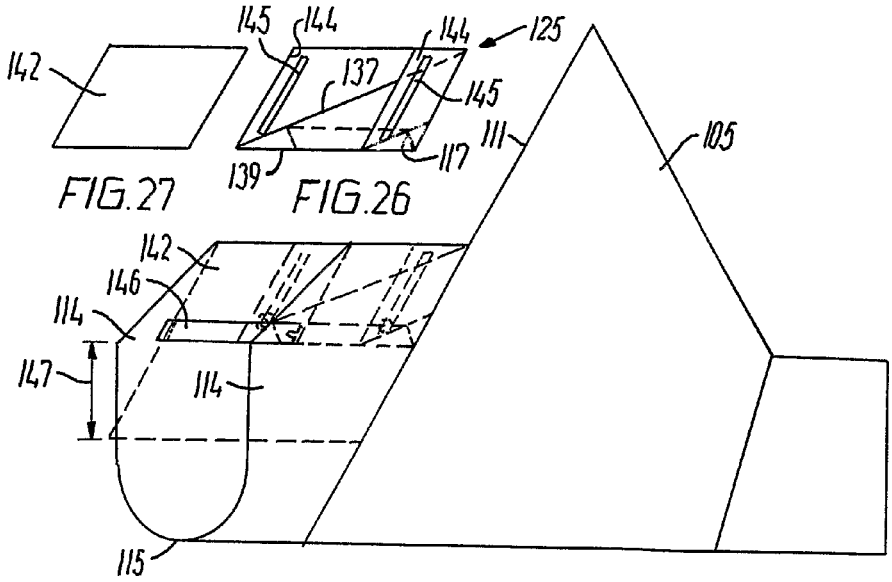
FIG.27 FIG.26
FIG. 23
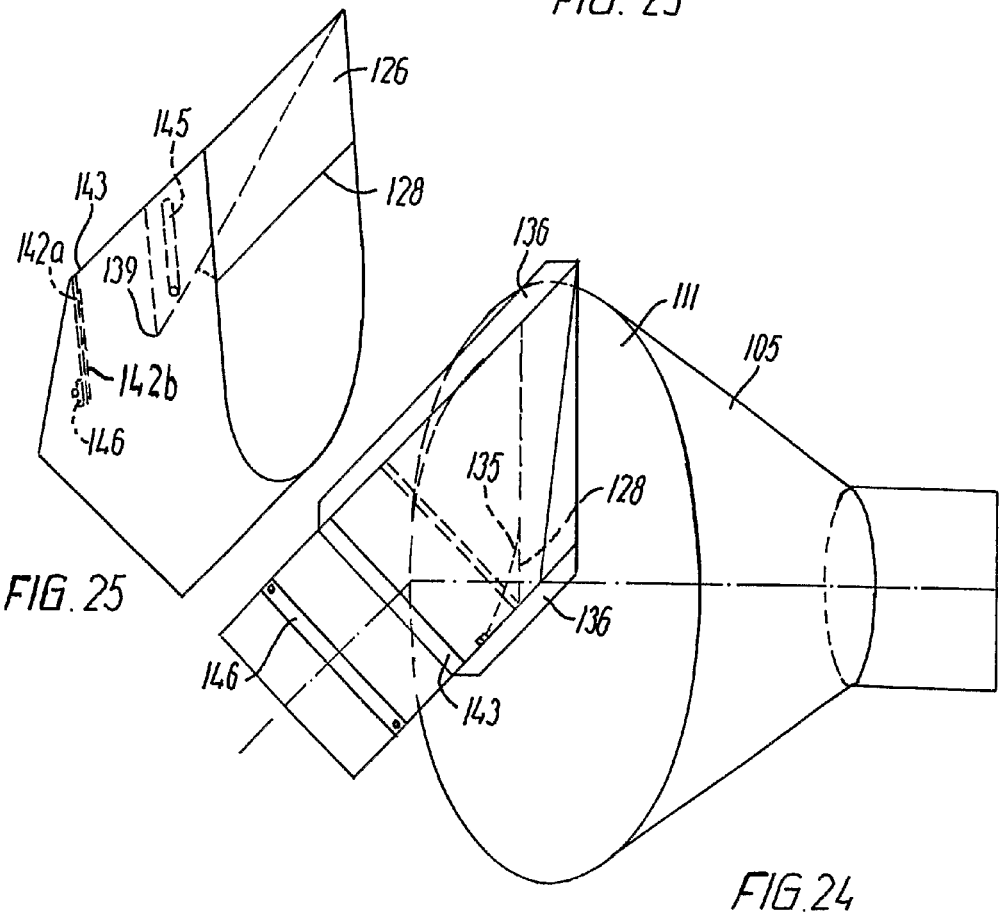
FIG. 25
FIG.24

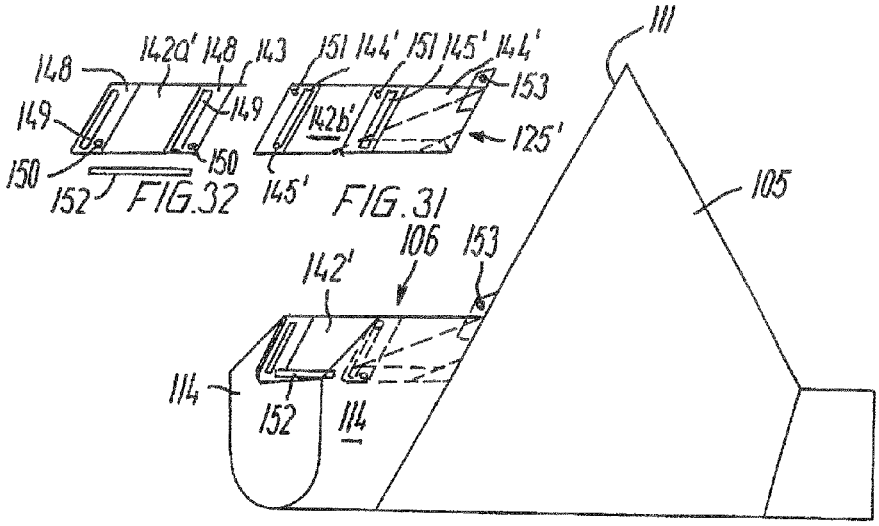
FIG.32 FIG.31
FIG. 28
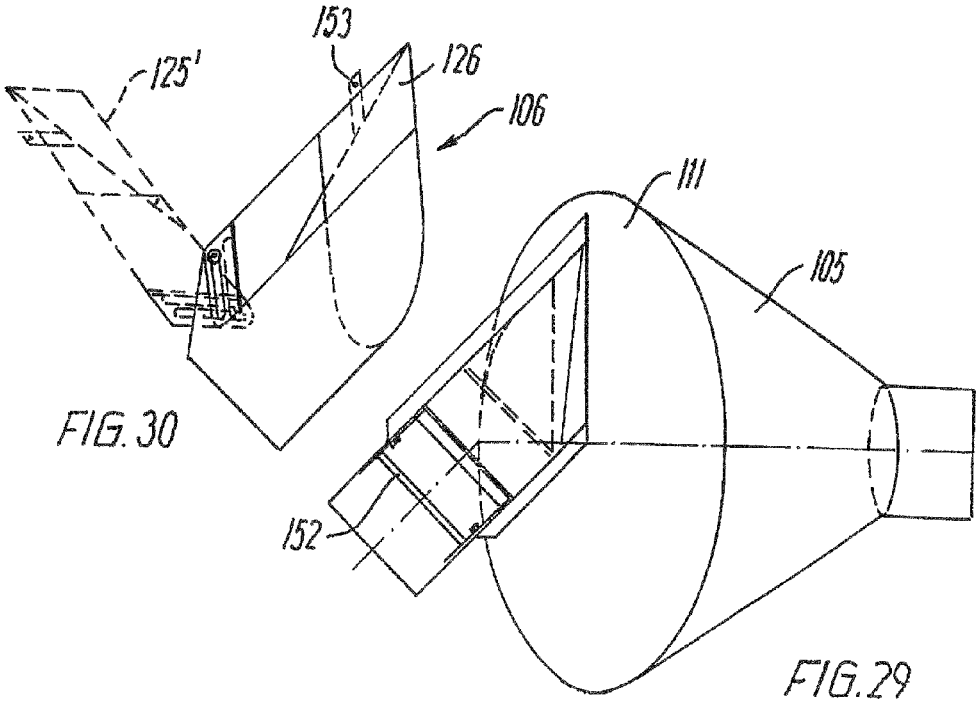
FIG. 30
FIG. 29

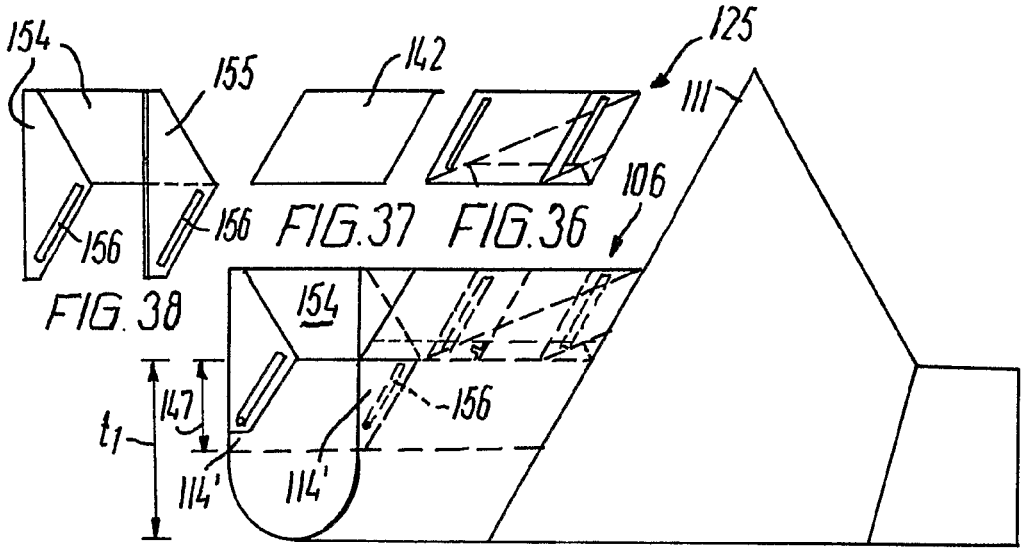
FIG. 38 FIG. 37 FIG. 36
FIG. 33
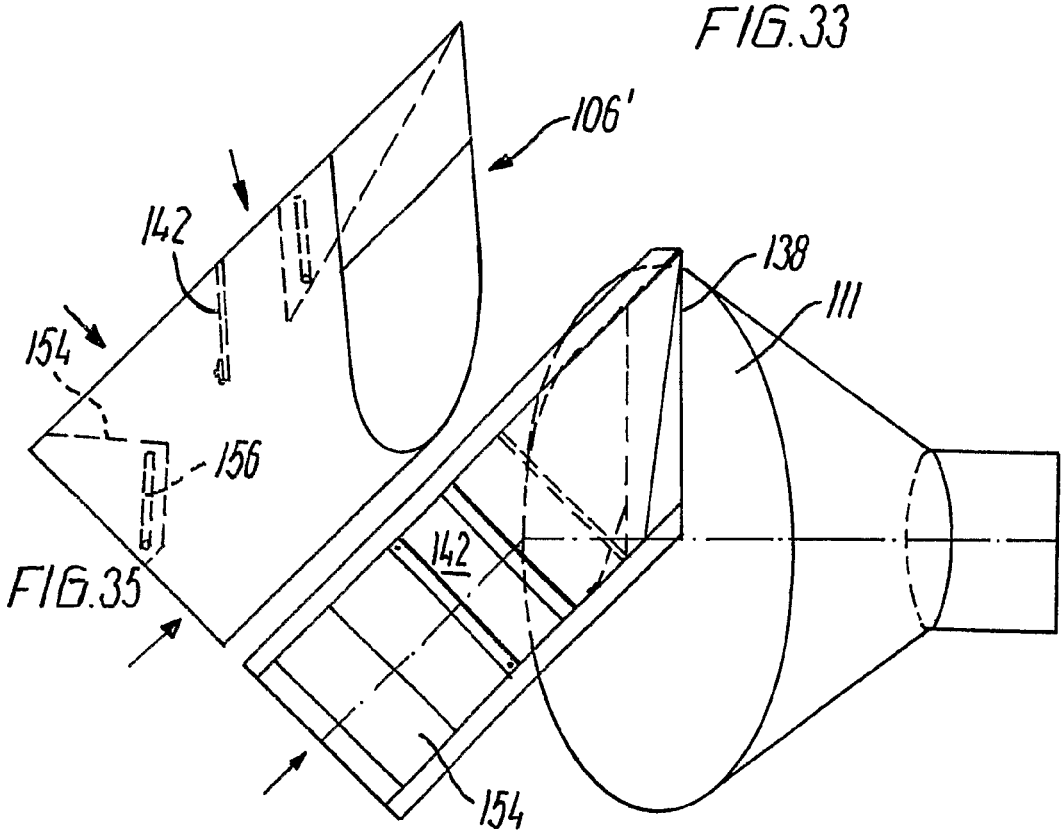
FIG. 35
FIG. 34

VORTEX BRAKE FOR A LIQUID DRAINAGE SYSTEM

The invention relates to a vortex brake for a liquid drainage system with a vortex chamber, an inlet section, and an outlet, wherein liquid can flow into the inlet section, through this into the vortex chamber, through this and out through the outlet, said vortex chamber having a side wall following a conical face, and a base wall, the conical face having a cone axis, and the outlet being located at an apex of the conical face, said inlet section having side walls and a bottom wall that extend mutually in parallel in a direction of flow in the inlet section, and a ceiling.

Vortex brakes of this type are known from U.S. Pat. Nos. 5,052,442, 6,053,206 and GB-A-2 254 938.

The invention thus particularly relates to a vortex brake for a sewer system. Such a vortex brake is usually placed at the bottom of a pool or a well with its outlet in the outlet of the pool or well, after which concrete is cast around the vortex brake so that a channel is formed leading to the inlet section, and access to the outlet of the pool or well by going round the vortex brake is impossible.

It is desirable to be able to adjust the characteristics of the vortex brake, and it is therefore known from U.S. Pat. No. 5,052,442 and U.S. Pat. No. 6,053,206 above to arrange a flow-affecting member at the inlet section. The flow-affecting member may be a flow-smoothening member that increases the maximum flow or it may be a cover member that partially blocks the sectional area of flow in the inlet section and reduces the maximum flow. It should be noted that on reduction of the maximum flow it is desirable to have the largest possible minimum flow area in order to avoid the risk of clogging due to more or less solid impurities in the liquid.

It is an object of the present invention to provide a vortex brake of the type stated above that gives a good possibility of adjusting the characteristics of the brake.

According to an aspect of the present this is achieved by the fact that the ceiling of the inlet section has a converging ceiling portion, which extends between a first and a second end of said ceiling portion, and which, in said direction of flow, extends converging towards the bottom wall. A vortex brake with such an inlet section may be used without a flow-affecting member but is very suitable for use with a flow-affecting member because the converging ceiling portion in itself may act as part of a flow-smoothening member and thus contribute to enabling a relatively large maximum flow compared to known inlet sections where the entire ceiling is parallel to the bottom wall in the inlet section. At the same time, the converging ceiling portion together with a cover member can make room under the ceiling in the inlet section for an eddy, which supports contraction of the inflowing liquid stream, which increases the braking effect of the vortex brake and thus reduces the maximum flow at a given minimum sectional area for the flow in the inlet section.

The inlet section is preferably connected with the base wall near the side wall of the vortex chamber, and the inlet section preferably has a central longitudinal axis extending in said direction of flow and forming an acute angle with the base wall; the longitudinal axis and the cone axis being mutually skewed. This corresponds to what is known from U.S. Pat. No. 6,053,206 above.

Preferably, the ceiling portion is plane, the inlet section has a U-shaped cross-section, and the first and second ends of the ceiling portion extend rectilinear in planes perpendicular to the longitudinal axis and perpendicular to a symmetry axis for the U-shape of the cross-section. By this an inlet section is obtained which is relatively easy to manufacture, for instance from steel sheet. The inlet section then preferably comprises a triangular ceiling portion extending between the converging ceiling portion and the H base wall of the vortex chamber, and extending parallel to the direction of flow.

As mentioned, a flow-affecting member can be attached at the first end of the converging ceiling portion. This may be a flow-smoothening member or it may be an inlet cover member. In the case of an inlet cover member, this preferably extends in the direction of flow diverging in relation to the bottom wall so as to allow room for an eddy in the inlet section as mentioned.

In a preferred embodiment, wherein the side walls of the inlet section in a direction transverse to the direction of flow are mutually parallel, wherein the vortex brake is provided with an inlet cover member, and wherein the inlet section is connected with the base wall, the inlet section is mounted with a cover member comprising the inlet cover member in the form of an inlet cover plate and comprising a chamber cover plate, wherein the inlet cover plate is placed at the first end of the converging ceiling portion, the chamber cover plate is placed in the vortex chamber near and parallel to the base wall, and wherein the inlet cover plate, in a plane parallel to the side walls, extends parallel to the chamber cover plate, and the inlet cover plate and the chamber cover plate are mutually connected by means of an intermediate plate extending parallel to the ceiling of the inlet section. By partial blocking of the entrance to the inlet section, an inlet opening between the inlet section and the vortex chamber can thus be blocked correspondingly so that any risk of reflux from the vortex chamber to the inlet section is reduced.

According to another aspect of the invention, there is provided a vortex brake for a liquid drainage system with a vortex chamber, an inlet section, and an outlet, wherein liquid can flow into the inlet section, through this into the vortex chamber, through this and out through the outlet, said vortex chamber having a side wall following a conical face, and a base wall, the conical face having a cone axis, and the outlet being located at an apex of the conical face, wherein the inlet section is connected to the base wall at an inlet opening therein near the side wall of the vortex chamber, said inlet section having mutually parallel side walls, and a bottom wall that, in a direction of flow in the inlet section, extends parallel to the side walls, and a ceiling extending from an upstream end of the ceiling to the vortex chamber, and in which inlet section between the side walls is mounted a cover member comprising an inlet cover portion at the upstream end of the ceiling and a chamber cover portion at the base wall extending parallel to this; the cover member constituting the ceiling of the inlet section. The characteristics of a vortex brake with a given vortex chamber can thus be adjusted by the placement level of the cover member.

Preferably, the cover member can be adjusted by shifting parallel to the base wall, so that the chamber cover portion covers a bigger or smaller part of the inlet opening. The fact that the cover member can be "adjusted by shifting" means that the cover member, when mounted, is not so thorough attached that it cannot subsequently be released. The characteristics of the vortex brake after the first adjustment can thus be changed, e.g. with changed needs.

In a preferred embodiment wherein the inlet cover portion and the chamber cover portion each have a lower edge, said lower edges are preferably located at the same distance from the bottom wall of the inlet section. This means that on the one hand the free part of the inlet opening between the inlet section and the vortex chamber is not smaller than the entrance to the inlet section, thus avoiding the risk of clogging within the inlet section, and on the other hand the smallest possible risk of reflux from the vortex chamber to the inlet section is achieved.

Preferably, said lower edges are horizontal in an operating position for the vortex brake.

In a preferred embodiment, the side walls of the inlet section extend to a certain level, and a blocking plate, placed in a position upstream of the inlet cover portion, blocks between the side walls from said level and down to a second, lower level. This means that, e.g. water being led through the vortex brake at a small flow runs under the blocking plate and through the inlet section without significant contraction of the jet, whereas said water, at a larger flow, will rise up to the blocking plate, and when the impounded water height exceeds the first mentioned level, part of the water will run over the blocking plate and the side walls, and this part will encounter the part of the water that has run under the blocking plate severely contracting the united jet in the inlet section, which leads to a powerful braking effect of the vortex brake. A similar effect is known per se through U.S. Pat. No. 5,052,442 above.

Preferably, the blocking plate extends upwards from the second, lower level sloping towards the vortex chamber to the first level. This means that an increased brake effect is achieved when the impounded water height upstream of the vortex brake has reached the second, lower level.

Preferably, the blocking plate has a bottom edge that can be shifted downwards from the second, lower level. This means that an improved opportunity of adjusting the total characteristics of the vortex brake is achieved. In this connection, the blocking plate can be two-parted with a fixed and a movable part.

Preferably, at least part of the blocking plate comprising said bottom edge is a fixed part of the cover member. So that the bottom edge location of the blocking plate can be adjusted together with the remaining part of the cover member.

To further allow the possibility of affecting the characteristics of the vortex brake, a second blocking plate is preferably placed between the side walls upstream of the first mentioned blocking plate.

The second blocking plate, in a vertical plane parallel to the direction of flow, preferably slopes in the opposite direction of the first mentioned blocking plate. By this a smoothening effect on the flow of water into the vortex brake is achieved, and thus a larger flow, until the impounded height has reached the first level and water begins to run over the side walls and the blocking plates.

The cover member may at its end most distant from the vortex chamber be hinged to the side walls with a hinge axis perpendicular to the side walls. This allows the possibility of creating a bypass in the case of clogging by swinging the cover member up and thereby opening the top side of the inlet section.

Preferably, the ceiling in the inlet section, seen in the direction of flow from its upstream end, first has a diverging portion in relation to the bottom wall of the inlet section and then a converging portion. As in the first aspect of the invention, this makes room for an eddy under the ceiling, which increases the contraction of the inrunning jet in the inlet section.

As used herein, diverging and converging portions mean portions with an average inclination of at least 5° in relation to the bottom wall.

In an embodiment of a vortex brake wherein the inlet section comprises a fixed ceiling, the cover member can be placed beneath the fixed ceiling in such a way that the inlet cover portion is placed at a first end of the fixed ceiling and the chamber cover portion is placed in the vortex chamber near the base wall when the inlet cover portion, in a plane parallel to the side walls, extends parallel to the chamber cover portion, and the inlet cover portion and the chamber cover portion are mutually connected by means of an intermediate portion extending parallel to the fixed ceiling. This allows a given vortex brake to be provided with an inlet cover member for partially blocking the entrance to the inlet section, whereby an inlet opening between the inlet section and the vortex chamber can be blocked correspondingly so that any risk of back travel from the vortex chamber to the inlet section is reduced.

According to a third aspect of the invention, there is provided a vortex brake for a liquid drainage system with a vortex chamber, an inlet section, and an outlet, wherein liquid can flow into the inlet section, through this into the vortex chamber, through this and out through the outlet, said vortex chamber having a side wall following a conical face, and a base wall, the conical face having a cone axis, and the outlet being located at an apex of the conical face, said vortex brake, in the vicinity of the outlet, being provided with a flexible gasket extending along the side wall on an outer side of the vortex chamber. This makes it much easier to cut the vortex brake out from the concrete than a brake with a conventional discharge spout if replacement of the brake is needed, e.g. because a larger or smaller brake is required. When mounting the brake, this also allows placement thereof at an angle in relation to the outlet from the pool or well so that the channel leading to the inlet section can be given a more straight design for the benefit of the flow at the bottom of the pool or well.

The gasket is preferably made of a foam material, especially foam rubber or foam plastic, and the gasket is preferably annular.

Figure 2:
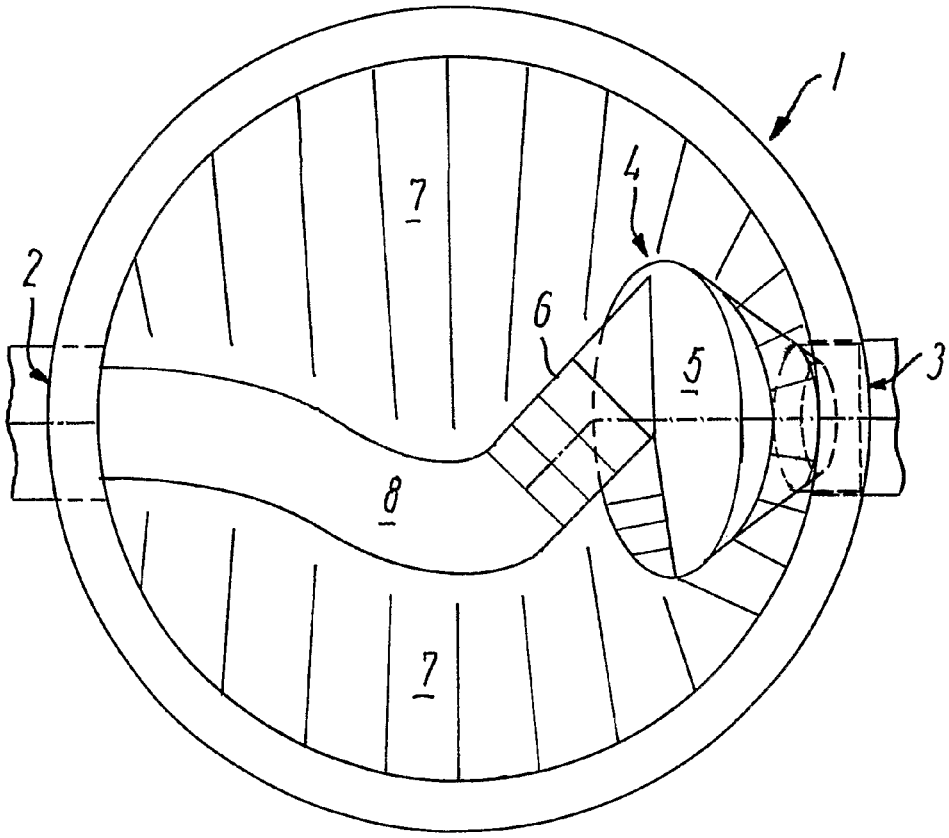
Figure 3:
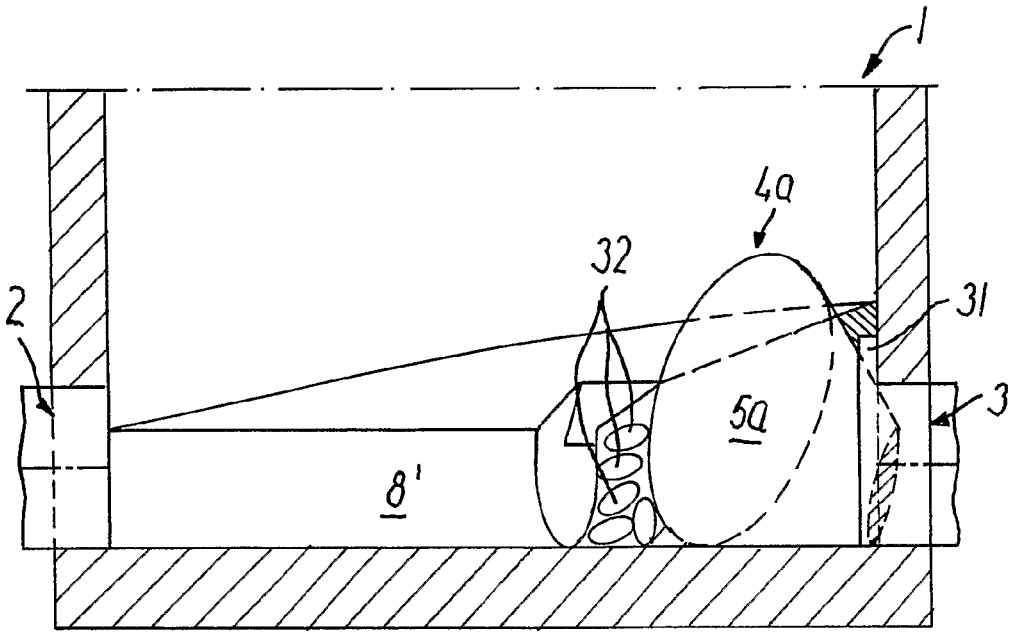
Figure 4:
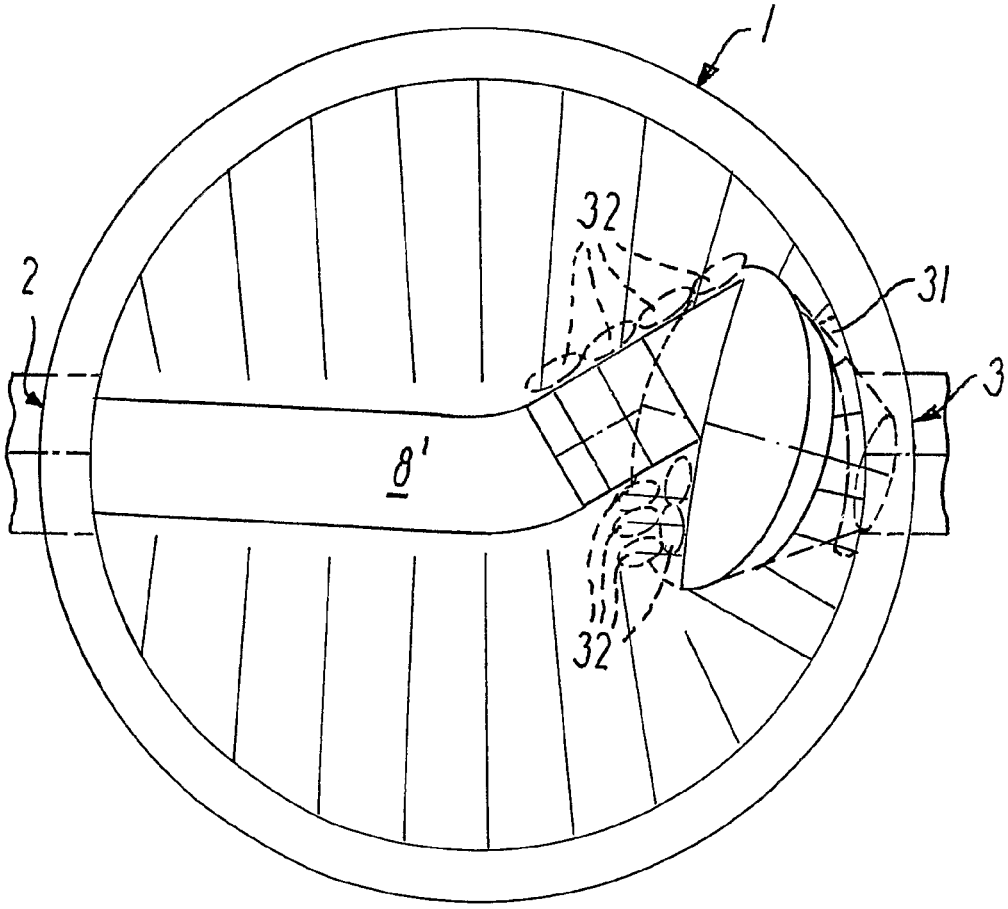
Figure 5:
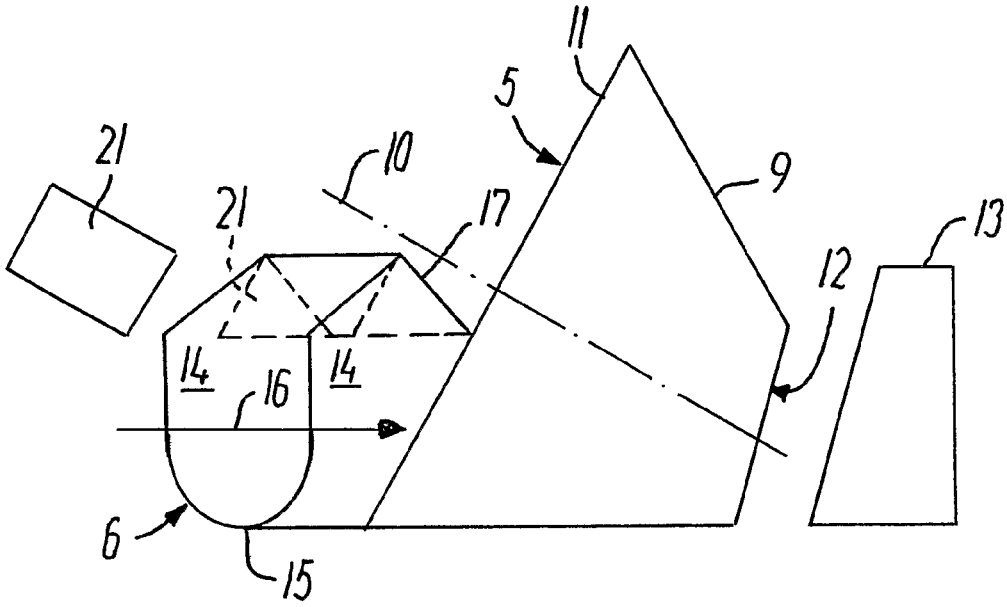
Figure 6:
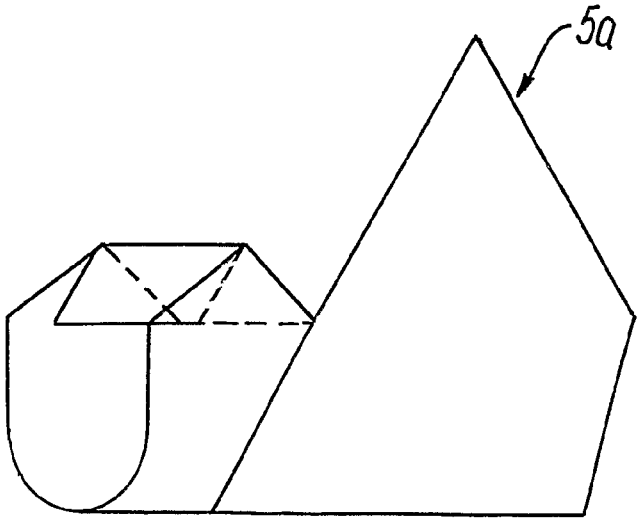
Figure 7:
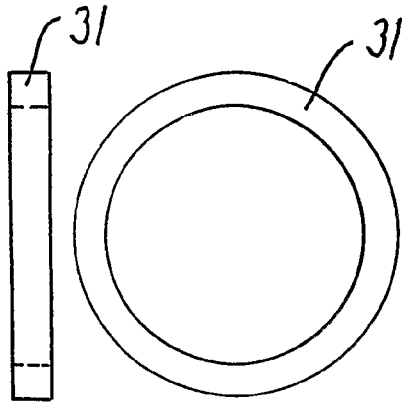
Figure 8:
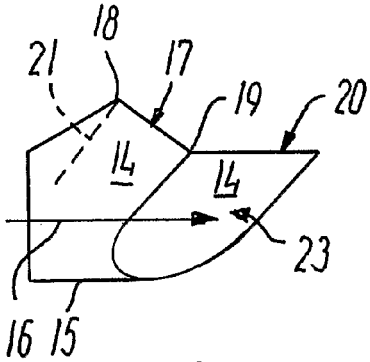
Figure 9:
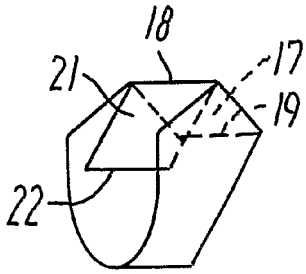
Figure 10:
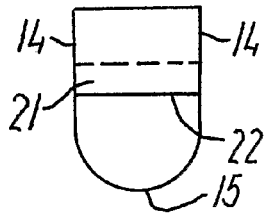
Figure 11:
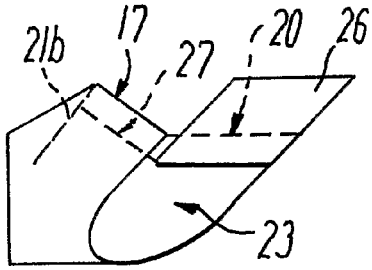
Figure 12:
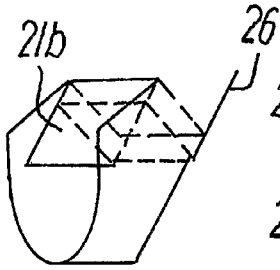
Figure 13:
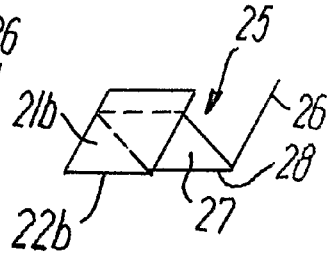
Figure 14:
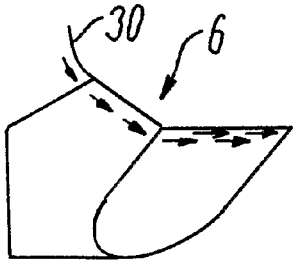
Figure 15:
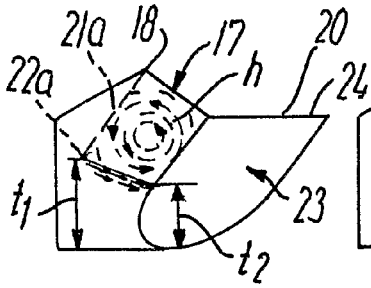
Figure 16:
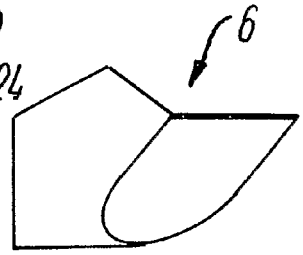
Figure 17:
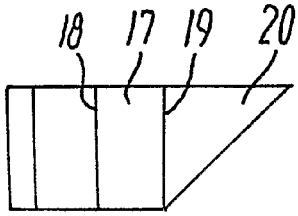
Figure 19:
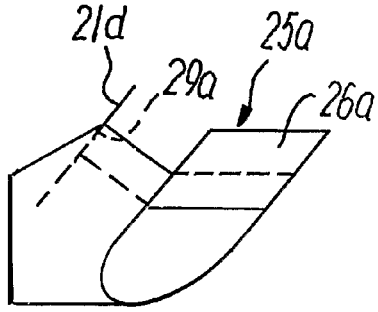
Figure 20:
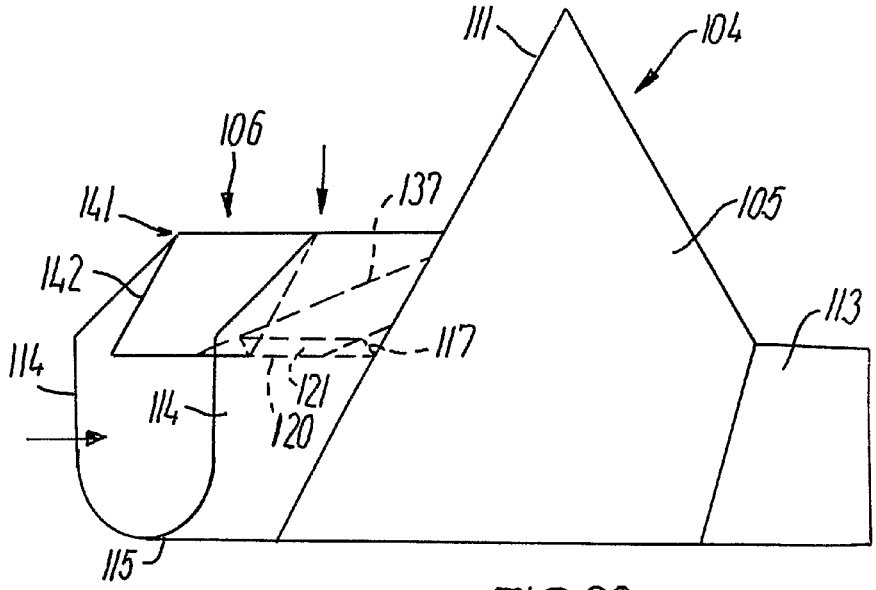

In the following, the invention will be explained in more detail by means of exemplified embodiments with reference to the schematical drawings in which FIG. 1 shows a vertical section through a well wherein a vortex brake of the invention is mounted at the well outlet, FIG. 2 is a plan view of the well in FIG. 1, FIG. 3 shows a vertical section through a well wherein a second vortex brake of the invention is mounted at the well outlet, FIG. 4 is a plan view of the well in FIG. 3, FIG. 5 is a partially exploded side view of a vortex brake of the invention, FIG. 6 is a partially exploded view of a second vortex brake of the invention, FIG. 7 is an end view of a flexible gasket in FIG. 6, FIG. 8 is a side view of an inlet section, FIG. 9 is a perspective view of the inlet section in FIG. 8, FIG. 10 is an end view of the inlet section in FIG. 8, FIG. 11 is a side view of an inlet section with a fixed cover member, FIG. 12 is a perspective view of the inlet section in FIG. 11, FIG. 13 is a perspective view of the cover member in FIGS. 11 and 12, FIG. 14 shows an inlet section with a flow-smoothening member bolted on, FIG. 15 shows the inlet section in FIG. 14 with an inlet cover member bolted on, FIG. 16 shows the inlet section in FIGS. 14 and 15 without any element bolted on, FIG. 17 is a plan view of the inlet section in FIG. 8 or 15, FIG. 18 a side view with an inlet section in another embodiment with an inlet cover member, FIG. 19 a side view of the inlet section in FIG. 18 with a cover member, FIG. 20 shows a side view of an additional embodiment of a vortex brake of the invention, FIG. 21 the vortex brake in FIG. 20 viewed from above, FIG. 22 the inlet section of the vortex brake in FIGS. 20 and 21 viewed from the side, FIGS. 23-25 are views corresponding to FIGS. 20-22 of a variant of the embodiment shown therein, FIG. 26 a cover member of the variant in FIGS. 23-25, FIG. 27 a blocking plate of the variant in FIGS. 23-25, FIGS. 28-32 an additional, preferred variant of the variant shown in FIGS. 23-27, FIGS. 33-35 FIGS. 23-25 are views corresponding to FIGS. 20-22 of a third variant of the embodiment shown therein, FIGS. 36 and 37 a cover member and a blocking plate, respectively, for the third variant, and FIG. 38 a second blocking plate in the third variant.

FIGS. 1 and 2 show a well 1 of the type used in a drainage system for wastewater and/or rainwater. The well 1 has an inlet 2 and an outlet 3. At the outlet 3 of the well is mounted a vortex brake 4 with a vortex chamber 5 and an inlet section 6. The bottom 7 of the well 1 is shaped by concrete that is cast after placement of the vortex brake 4 and shaped in such a way that a channel 8 extends from the inlet 2 of the well to the inlet section 6. The bottom 7 is designed so that liquid in the well 1 is led into the channel 8, which is substantially horizontal but has a small slope towards the inlet section 6 so that liquid in the well will always go to the outlet 3.

The vortex brake 4 is shown more detailed in FIG. 5 and comprises the conical vortex chamber 5 and the inlet section 6. The vortex chamber 5 has a side wall 9 that constitutes part of a conical face with a cone axis 10. The vortex chamber 5 has a base wall 11 which in the shown embodiment is plane and perpendicular to the cone axis 10. The vortex chamber has an outlet 12 at the apex of the conical face; the vortex chamber 5 having the shape of a crooked truncated cone.

Around its outlet 12, the vortex chamber is provided with a circular cylindrical discharge spout 13, which, as shown in the drawing, is angularly truncated in order to match the cone shape of the vortex chamber. In FIG. 5 the discharge spout 13 is shown removed from the vortex chamber; however, usually it will for instance be welded onto the vortex chamber. The discharge spout 13 serves two purposes in connection with mounting and embedding the vortex brake. The discharge spout 13 fits in the outlet 3 of the well and thus helps to position the vortex brake 4 during mounting. At the same time, the discharge spout 13 closes off the outlet 3 of the well so that concrete cannot run out through the outlet during casting.

In the following, the inlet section 6 will be described. In all the shown exemplary embodiments, the inlet section 6 has some features that do not differ from example to example. These common features that are only exemplary are described in the following.

In the shown embodiment, the inlet section 6 is connected with the base wall 11 of the vortex chamber 5. The inlet section 6 has two mutually parallel side walls 14 and a bottom wall 15 that extends parallel to the side walls 14 in a direction of flow 16 of the inlet section. Therefore, the lower parts of the side walls 14 and the bottom wall 15 together make up a part of a cylinder face, as the inlet section 6 in the shown exemplary embodiments is rectilinear. In the exemplary embodiments, the side walls 14 and the bottom wall 15 merge into each other and so form a U-shaped cross-section transverse to the direction of flow 16, which is shown most clearly in FIG. 10.

In addition to the side walls 14 and the bottom wall 15, the inlet section has a ceiling. The ceiling comprises a ceiling portion 17, which in the direction of flow 16 converges towards the bottom wall 15. The converging ceiling portion 17 extends between a first end 18 and a second end 19. At the second end 19 the converging ceiling portion is connected with a triangular ceiling portion 20 that is substantially horizontal but is parallel to the bottom wall 15 of the inlet section 6. By means of the triangular ceiling portion a continuous ceiling is formed from the first end 18 of the converging ceiling portion 17 to the base wall 11 of the vortex chamber 5. The two ceiling portions 17 and 20 are both plane to facilitate the production of the vortex brake 4.

At the first end 18 of the converging ceiling portion 17, and possibly under the ceiling as a whole, flow-affecting members can be mounted, as will be explained below with reference to FIGS. 8-19; different figures showing different possibilities.

FIG. 8-10 show the inlet section 6 with a flow-affecting member in the form of an inlet cover member, which more particularly is designed as an inlet cover plate 21 that blocks part of the inlet cross-section or the entrance to the inlet section 6. The inlet cover plate 21 has a bottom edge 22 that together with the side walls 14 and the bottom wall 15 of the inlet section 6 defines the entrance to the inlet section 6. The inlet cover plate 21 is firmly mounted, for instance welded on.

FIG. 15 shows a design which substantially corresponds to the one shown in FIGS. 8-10. However, an inlet cover plate 21*a* in FIG. 15 is not welded but bolted on the first end 18 of the converging ceiling portion 17; the inlet cover plate 21*a* having bent-in edge at the top, said edge abutting the underside of the converging ceiling portion 17.

FIG. 15 illustrates how an eddy, h, is formed in areas beneath and between the converging ceiling portion 17 and the inlet cover plate 21*a*, said eddy supporting a contraction of a jet of inflowing liquid. The cross-section, t2, of said jet in the down-stream end of the inlet section 6 is thus smaller than the cross-section, t1, of the jet in the upstream end by the entrance; the cross-section, t1, of the jet being determined by a bottom edge 22*a* of the inlet cover plate 21*a*. At the downstream end of the inlet section 6 there is an inlet opening 23 that is defined by the bottom wall 15 and side walls 14 of the inlet section 6 together with a connecting edge 24 of the triangular ceiling portion 20; along which connecting edge 24 the triangular ceiling portion 20 is connected with the base wall 11 of the vortex chamber 5. Through this inlet opening 23, the inlet section is in flow communication with the vortex chamber.

As shown in FIG. 15, the jet of inflowing liquid only fills out part of the inlet opening 23, thereby leaving a risk of reflux of liquid from the vortex chamber 5 to the inlet section 6 to the detriment of vortex formation in the vortex chamber 5 which in a way known per se provides the braking effect of the vortex brake.

In order to minimize the risk of or the amount of said reflux, there is provided an embodiment, as shown in FIGS. 11-13, wherein an inlet cover plate 21*b* or inlet cover portion is part of a cover member 25. As best shown in FIG. 13, which shows the cover member 25 alone, this cover member 25 comprises a chamber cover plate or chamber cover portion 26 which, in a section parallel to the side walls 14 of the inlet section 6, extends substantially parallel to the inlet cover plate 21*b*. The inlet cover plate 21*b* and the chamber cover plate 26 are mutually connected by an intermediate plate 27 with a shape and size corresponding to the two above ceiling portions 17 and 20 together.

With this cover member 25 the chamber cover plate can define the inlet opening 23 upwards at the same level as the entrance is defined by the inlet cover plate 21*b*'s bottom edge 22*b*; the latter and a bottom edge 28 of the chamber cover plate 26 lying in a plane parallel to the bottom wall 15 of the inlet section 6. However, the so defined opening always allows passage of a lump impurity that may have passed the entrance.

Figure 18:
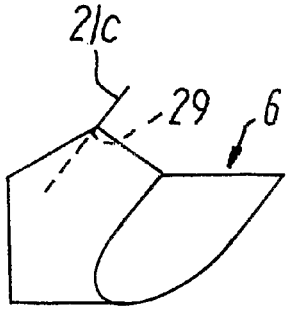

FIG. 18 shows an embodiment of an inlet cover plate 21*c* that is adjustable, as it can be shifted up and down in its plane. In this case, the inlet section 6 has a strip member 29 at the first end 18 of the converging ceiling portion 17, said strip member 29 being parallel to the inlet cover plate 21*c*, and to which the inlet cover plate can be attached.

A corresponding strip member 29*a* can be found in the embodiment shown in FIG. 19, wherein a cover member 25*a* is adjustably mounted. The adjustability is possible because an inlet cover plate or inlet cover portion 21*d* and the chamber cover plate or chamber cover portion 26*a* as stated above in connection with FIGS. 11-13 are parallel. The chamber cover plate 26*a* can therefore abut the plane base wall 11 of the vortex chamber and slide along this base wall within the vortex chamber 5 while the inlet cover plate slides along the strip member 29*a* when the position of the cover member 25*a* is adjusted up or down.

If the intermediate plate of the cover member is connected with the inlet cover plate at the lower edge thereof, such an adjustable cover member can be used in connection with a vortex brake having an inlet section with a plane, substantially horizontal ceiling, while the bottom edges of the inlet and chamber cover plates, respectively, lie in a plane parallel to the bottom wall in the inlet section.

FIGS. 14 and 16 illustrate the fact that a cover member or inlet cover member may be left out (FIG. 16) or replaced by a flow-smoothening member 30 if a larger flow capacity is desired for the vortex brake.

Liquid drainage systems for which the vortex brake of the invention is intended to be used may be of different types. They may be systems for draining rainwater, mainly without impurities, and they may be systems for draining wastewater, which may be polluted with solid elements. In the latter case there is a substantial risk of clogging and the aim should be not to have projections at the inlet of the vortex brake where impurities can accumulate.

In order to avoid such projections where impurities (paper and other things) may accumulate, the area between the converging ceiling portion 17 and the base wall 11 of the vortex brake is preferably filled with concrete when the vortex brake is mounted. If an adjustable cover member is used, or is to be used, it can be placed in its top position so that concrete can be cast behind the inlet cover plate in the maximum height thereof. Subsequently, the cover member can be adjusted down to the desired height, thus leaving a sloping area of exposed concrete without projections to catch impurities.

FIGS. 3-4 and 6-7 show a vortex brake 4*a*, wherein the vortex chamber 5*a*, contrary to the embodiment shown in FIG. 1-2 and 5, is not provided with a discharge spout. Instead, the vortex chamber 5*a* is provided with a flexible gasket 31. This can be made of any suitable material, for example elastic, viscoelastic or plastic material. Preferably, foam rubber or foam plastic. The primary object of the gasket is to prevent concrete from running out through the outlet 3 of the well during casting around the vortex brake 4*a*.

The flexible gasket is, as shown in the example in FIG. 7, annular and circular. Alternatively, it may be oval in relaxed state, however, due to the flexibility; the circular gasket may assume an oval shape corresponding to the surface of the vortex chamber when the gasket is placed as shown in FIG. 3

Several advantages are achieved with such a flexible gasket instead of a discharge spout: The vortex brake can be mounted with a tilt in relation to the outlet 3 of the well as shown in FIGS. 3 and 4. This allows the channel 8' at the bottom of the well to be more rectilinear for the benefit of the flow therein and the self-cleaning effect of the system. As the discharge spout is missing, it is much easier to cut the vortex brake out of the concrete if, at a later time, the vortex brake needs to be replaced, for example by a larger or smaller vortex brake. The easier cutting out is improved if the vortex brake during mounting is supported by sandbags 32, which may be required as the supporting effect of the discharge spout is lacking. In this case, sandbags 32 may be filled around the vortex brake so that only a relatively thin layer of concrete must be cast.

Figure 22:
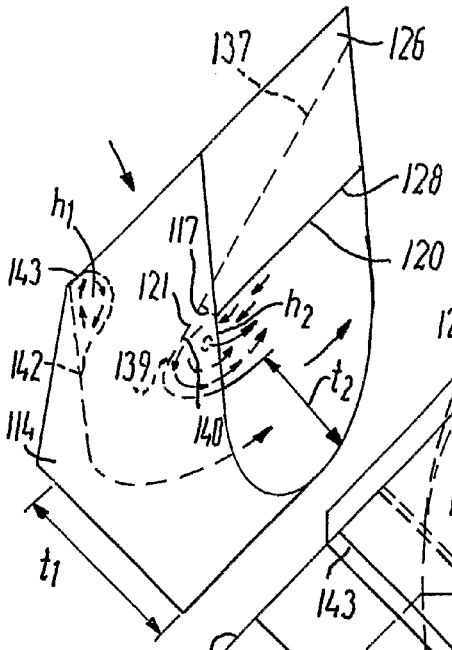
Figure 21:
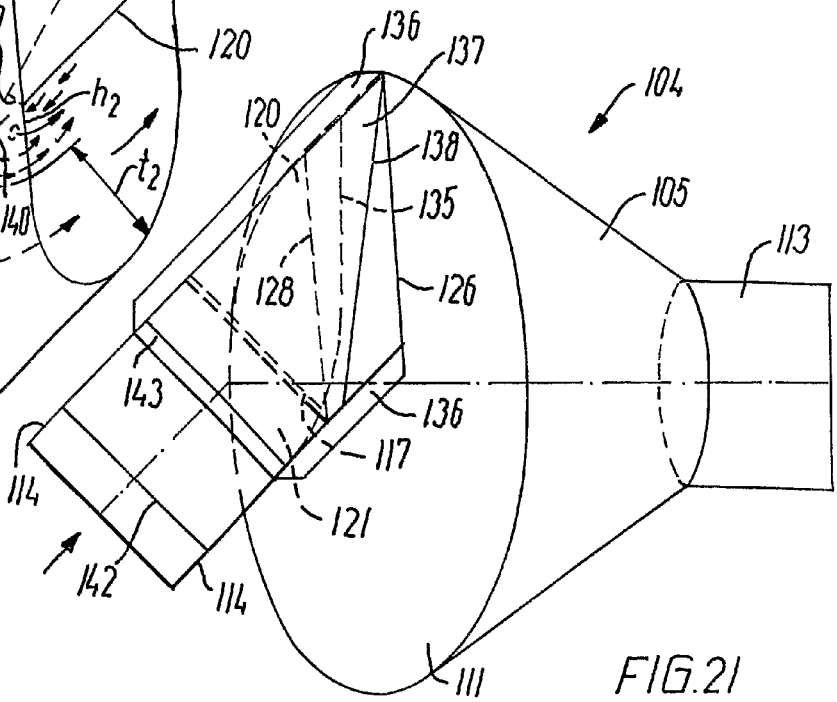

FIGS. 20-22 show another embodiment of a vortex brake 104 of the invention comprising a conical vortex chamber 105 with a discharge spout 113, a base wall 111 and an inlet section 106. The inlet section 106 comprises a U-shaped sheet piece forming a bottom wall 115 and two mutually parallel side walls 114. The inlet section joins an inlet opening 135 in the base wall 111. The side walls 114 have bent-out side flanges 136 at the top for reinforcing and stabilizing the side walls 114. The side walls 114 extend up to an upper level 141.

In the inlet section 106 plate members are mounted, which collectively form a ceiling in the inlet section and define the free flow height or the free sectional area of flow, t1, through the inlet section and into the vortex chamber 105 so that some of these plate members serve as cover. At the end of the inlet section 106 and in abutment with the base wall 111 there is a chamber cover plate 126 which, due to its placement level, covers the upper part of said inlet opening 135 in the base wall 111. The chamber cover plate 126 is rectangular and has a horizontal bottom edge 128 in the operating position of the vortex brake. From the bottom edge 128 a triangular ceiling portion 120 extends substantially horizontal, i.e. parallel to the bottom wall 115, which preferably has a small inclination in order to make sure that water in the vortex brake 104 runs through the inlet section 106 and the vortex chamber 105. As with the first described embodiments the triangular ceiling portion 120 is connected with a converging ceiling portion 117.

The chamber cover plate 126, the triangular ceiling portion 120, and the converging ceiling portion 117 may e.g. consist of plate parts welded together or may be portions of a single, folded plate item.

Over the converging ceiling portion 117 and the triangular ceiling portion 120 extends a trapezoidal cover plate 137. This extends from a first edge 138, which is in abutment with the chamber cover plate 126, and slopes downwards to a horizontal, second edge 139. Between its two said edges the cover plate 137 is connected with the converging ceiling portion 117. The portion of the cover plate 137 between the second edge 139 and the converging ceiling portion 117 forms an inlet cover portion or inlet cover plate 121, the underside of which constitutes a diverging ceiling portion 140.

A blocking plate 142 is mounted upstream of the plate members described so far and mounted in the inlet section 106. This blocking plate 142 extends from the upper level 141 of the side walls 114 and slopes down to the same level as the triangular ceiling portion 120 and the second edge 139 of the cover plate 137. At the top the blocking plate has a turned-in, horizontal flange 143.

The vortex brake 104 described herein in connection with FIGS. 20-22 works in the following way; it being intended to be mounted in a well in the same way as shown in FIG. 1.

With small liquid streams the liquid will flow under the blocking plate 142, directly through the rest of the inlet section 106, into the vortex chamber 105 and through this.

When the liquid in the well reaches a level exceeding the level of the bottom edge of the blocking plate 142, a contraction of the jet of water flowing under the blocking plate 142 will occur due to the inclination (diverging) of the blocking plate 142. The stream of water will thus not rise up to the cover plate 137's second edge 139 or the ceiling portions downstream of this. This provides a poor braking effect and thus a large flow, which causes a self-cleaning effect of the vortex brake 104 and the facilities upstream thereof because impurities can be rinsed off through the vortex brake 104.

When the liquid level in the well further rises to a level higher than the upper level 141 of the side walls 114 and the blocking plate 142, the liquid will, in addition to flowing under the blocking plate 142, also flow down between the side walls 114, the blocking plate 142, and the base wall 111. In this way the flow pattern indicated in FIG. 22 is build up. An eddy, h1, will thus be formed under the horizontal flange 143 of the blocking plate 142, and a second eddy, h2, will be formed under the ceiling portions, where especially the adjacent diverging and converging ceiling portions 140 and 117 that collectively form an arch in the ceiling of the inlet section 106 support formation of the second eddy, h2. This reduces the effective flow height, t2, and the jet of through-flowing liquid is contracted and accelerated prompting the known vortex formation in the vortex chamber 105. The smaller an achievable effective flow height, the larger contraction of the jet of through-flowing liquid, the larger achievable braking effect of the vortex brake 104. When a small effective flow height, t2, is achieved in a vortex brake 104 with a large free flow height, t1, a vortex brake with a good brake effect is achieved, which does not easily clog due to more or less solid impurities in the liquid.

The chamber cover plate 126, the triangular ceiling portion 120, the converging ceiling portion 117, and the trapezoidal cover plate 137 may be combined to a cover member that may be attached between the side walls 114 by spot welds. It is thus possible to free the cover member to change its location. The same applies to the blocking plate.

FIGS. 23-25 show a vortex brake which in construction and function is the same as the vortex brake shown in FIGS. 20-22 except that the chamber cover plate 126, the triangular ceiling portion 120, the converging ceiling portion 117, and the trapezoidal cover plate 137 are combined to a cover member 125 which is also provided with two mutually parallel side pieces 144 placed on either side of the cover member 125.

In the side pieces 144 there are mortises or grooves 145 that extend parallel to the chamber cover plate 126. This means that the cover member 125 can be height-adjustably attached between the side walls 114; screws being inserted through the grooves 145 and attached in threaded holes in the side walls 114.

The blocking plate 142 is attached to a bar 146 that is mounted between the side walls 114. In addition to serving the purpose of attaching the blocking plate 142 the bar 146 contributes to stabilizing the side walls 114.

The blocking plate 142 has two parts, 142*a* and 142*b*, lying over each other so that their overlap is adjustable. The one part 142*a* comprising the horizontal flange 143 can thus remain in a position corresponding to the one shown in FIG. 20, while the other part 142*b* can be shifted downwards so that the bottom edge of the combined blocking plate 142 is lowered.

It is thus possible to move the cover member 125 and the second part 142*b* of the blocking plate down and up, as illustrated with a double arrow 147, to adjust the characteristics of the vortex brake 104; the bottom edge of the blocking plate 142, the second edge 139 of the cover plate 137, and the triangular ceiling portion 120 preferably being maintained mutually at the same level over the bottom wall 115.

FIGS. 28-32 show a variant of the embodiment in FIGS. 23-27, wherein the side pieces 144' of the cover member 125' are extended to the blocking plate 142'. The first part 142*a*' thereof being provided with side flanges 148 having grooves 149 and holes 150 (see FIG. 32). The second part 142*b*' of the blocking plate 142' being mounted between the extended side pieces 144', and the side pieces having grooves 145' and holes 151 (see FIG. 31). This means that the second part 142*b*' of the blocking plate comprising the bottom edge of the blocking plate is a fixed part of the cover member 125'.

The cover member 125' is combined with the first part 142*a*' of the blocking plate when this is placed between the side pieces 144' so that the holes 150 in the side flanges 148 are flush with the grooves 145' in the side pieces 144', and the holes 151 in the side pieces 144' are flush with the grooves 149 in the side flanges 148.

The so combined cover member 125' and blocking plate 142' are placed between the side walls 114 of the inlet section 106 so that the holes 150 in the side flanges 148 (and thus also the grooves 145' in the side pieces 144') are flush with predrilled holes in the side walls 114, a rod 152 is led through these flush holes and grooves, and the ends of the rod are attached to the side walls 114.

Thereby the first part 142*a*' of the blocking plate is fixedly mounted between the side walls 114, while the cover member with the second part 142*b*' of the blocking plate can be shifted down and up parallel to the base wall 111; the rod 152 sliding in the grooves 145' in the side pieces 144'. The cover member 125' can be fixed in a desired position by means of screws that are inserted through the grooves 149 and attached in the holes 151, which may appropriately be threaded holes.

As illustrated in FIG. 30, the cover member 125' together with the first part 142*a*' of the blocking plate may be swung up around the rod 152 that acts as a hinge. This may provide a bypass, e.g. in the case of clogging of the passages into the inlet section. In order to enable an operator to swing up the cover member in this way it is provided with a small sheet piece with a hole 153 for attaching e.g. a chain for pulling.

FIGS. 33-38 show another variant of the embodiment in FIGS. 23-27. This other variant uses the same cover member 125 and blocking plate 142 as the embodiment in FIGS. 23-27 cf. FIGS. 36 and 37 and FIGS. 26 and 27, respectively. The side walls 114' of the inlet section 106' are, however, extended upstream, and in between them a second blocking plate 154 is mounted, which, as particularly seen in FIG. 35, slopes opposite the first blocking plate 142. The second blocking plate 154 has side pieces 155 with grooves 156 through which it is mounted by means of screws to shift down and up parallel to the base wall 111. The second blocking plate 154 can thus be placed at such a height that its bottom edge is located at the same level as the bottom edge of the first blocking plate 142.

This latter variant works in the way that with a liquid level, e.g. in a well in which the vortex brake is mounted, that exceeds the bottom edge of the second blocking plate 154 but does not exceed the top edge of the second blocking plate 154, the second blocking plate 154 will have a smoothening effect on the jet of liquid flowing under the second blocking plate so that a relatively large flow will be achieved.

When the liquid level exceeds the second blocking plate, this variant of the vortex brake will work substantially in the same way as the variants referred to in FIGS. 20-32.

The invention claimed is:

1. A vortex brake for a liquid drainage system with a vortex chamber, an inlet section, and an outlet, wherein liquid can flow into the inlet section, through the inlet section into the vortex chamber, through the vortex chamber and out through the outlet, said vortex chamber having a side wall following a conical face, and a base wall, the conical face having a cone axis, and the outlet being located at an apex of the conical face, said inlet section having side walls and a bottom wall that extend mutually in parallel in a direction of flow in the inlet section, and a ceiling, said ceiling having a converging ceiling portion which extends between a first and a second end of said ceiling portion, and which, in said direction of flow, extends converging towards the bottom wall.

2. A vortex brake as claimed in claim 1, wherein a flow-affecting member is attached at the first end of the converging ceiling portion.

3. A vortex brake as claimed in claim 1, wherein a flow-smoothening member is attached at the first end of the converging ceiling portion.

4. A vortex brake as claimed in claim 1, wherein an inlet cover member is attached at the first end of the converging ceiling portion.

5. A vortex brake as claimed in claim 4, wherein the inlet cover member, in the direction of flow, extends divergently from the bottom wall.

6. A vortex brake as claimed in claim 5, wherein the inlet section is connected to the base wall near the side wall of the vortex chamber;

wherein the inlet section's side walls, in a direction transverse to the direction of flow, are mutually parallel;

wherein the inlet section is mounted with a cover member comprising the inlet cover member in the form of an inlet cover plate and comprising a chamber cover plate, wherein the inlet cover plate is placed at the first end of the converging ceiling portion, the chamber cover plate is placed near and parallel to the base wall, and wherein a first intersection between the inlet cover plate, in a section parallel to the side walls and a second intersection between the chamber cover plate, and said plane parallel to the side walls are parallel, and the inlet cover plate and the chamber cover plate are mutually connected by means of an intermediate plate extending parallel to the ceiling of the inlet section.

7. A vortex brake as claimed in claim 1, wherein the inlet section is connected to the base wall near the side wall of the vortex chamber.

8. A vortex brake as claimed in claim 7, wherein the inlet section has a central longitudinal axis extending in said direction of flow and forming an acute angle with the base wall.

9. A vortex brake as claimed in claim 8, wherein said converging ceiling portion is plane, the inlet section has a U-shaped cross-section, and the first and second ends of the converging ceiling portion extend rectilinear in planes perpendicular to the longitudinal axis and perpendicular to a symmetry axis for the U-shape of the cross-section.

10. A vortex brake as claimed in claim 8, wherein the inlet section comprises a triangular ceiling portion extending between the converging ceiling portion and the base wall of the vortex chamber, and extending parallel to the direction of flow.

11. A vortex brake as claimed in claim 1, said vortex brake, in the vicinity of the outlet, being provided with a flexible gasket extending along the side wall on an outer side of the vortex chamber.

12. A vortex brake as claimed in claim 11, wherein the gasket is made of a foam material.

13. A vortex brake as claimed in claim 11, wherein the gasket is annular.

14. A vortex brake for a liquid drainage system with a vortex chamber, an inlet section, and an outlet, wherein liquid can flow into the inlet section, through the inlet section into the vortex chamber, through the vortex chamber and out through the outlet, said vortex chamber having a side wall following a conical face, and a base wall, the conical face having a cone axis, and the outlet being located at an apex of the conical face, wherein the inlet section is connected to the base wall at an inlet opening therein near the side wall of the vortex chamber, said inlet section having mutually parallel side walls, and a bottom wall that, in a direction of flow in the inlet section, extends parallel to the side walls, and a ceiling extending from an upstream end of the ceiling to the vortex chamber, and in which inlet section between the side walls is mounted a cover member comprising an inlet cover portion at the upstream end of the ceiling and a chamber cover portion at the base wall extending parallel to the base wall; the cover member constituting the ceiling of the inlet section.

15. A vortex brake as claimed in claim 14, wherein the cover member at its end most distant from the vortex chamber is hinged to the side walls with a hinge axis perpendicular to the side walls.

16. A vortex brake as claimed in claim 14, wherein the ceiling in the inlet section, from its upstream end, first has a diverging portion in relation to the bottom wall of the inlet section and then a converging portion.

17. A vortex brake as claimed in claim 14, where the inlet section comprises a fixed ceiling, wherein the cover member is placed beneath the fixed ceiling in such a way that the inlet cover portion is placed at a first end of the fixed ceiling, the chamber cover portion is placed near the base wall, and wherein a first intersection between the inlet cover portion and a plane parallel to the side walls and a second intersection between the chamber cover portion, and the inlet cover portion and the chamber cover portion are mutually connected by means of an intermediate portion extending parallel to the fixed ceiling.

18. A vortex brake as claimed in claim 14, wherein the inlet cover portion and the chamber cover portion each have a lower edge, said lower edges being located at the same distance from the bottom wall of the inlet section.

19. A vortex brake as claimed in claim 18, wherein said lower edges are horizontal in an operating position of the vortex brake.

20. A vortex brake as claimed in claim 14, wherein the side walls of the inlet section extend to a certain level, and a blocking plate, placed in a position upstream of the inlet cover portion, blocks between the side walls from said level and down to a second, lower level.

21. A vortex brake as claimed in claim 20, wherein the blocking plate from the second lower level extends upwards sloping towards the vortex chamber to the first level.

22. A vortex brake as claimed in claim 20, wherein the blocking plate has a bottom edge that can be shifted downwards from the second, lower level.

23. A vortex brake as claimed in claim 22, wherein at least part of the blocking plate comprising said bottom edge is a fixed part of the cover member.

24. A vortex brake as claimed in claim 20, wherein a second blocking plate is placed between the side walls upstream of the first mentioned blocking plate.

25. A vortex brake as claimed in claim 24, wherein the side walls of the inlet section extend to a certain level, and a blocking plate, placed in a position upstream of the inlet cover portion, blocks between the side walls from said level and down to a second, lower level, and wherein the second blocking plate, in a vertical plane parallel to the direction of flow, slopes in the opposite direction of the first mentioned blocking plate.

26. A vortex brake for a liquid drainage system with a vortex chamber, an inlet section, and an outlet, wherein liquid can flow into the inlet section, through the inlet section into the vortex chamber, through the vortex chamber and out through the outlet, said vortex chamber having a side wall following a conical face, and a base wall, the conical face having a cone axis, and the outlet being located at an apex of the conical face, wherein the inlet section is connected to the base wall at an inlet opening therein near the side wall of the vortex chamber, said inlet section having mutually parallel side walls, and a bottom wall that, in a direction of flow in the inlet section, extends parallel to the side walls, and a ceiling extending from an upstream end of the ceiling to the vortex chamber, and in which inlet section between the side walls is mounted a cover member comprising an inlet cover portion at the upstream end of the ceiling and a chamber cover portion at the base wall extending parallel to the base wall; the cover member constituting the ceiling of the inlet section;

wherein the cover member can be adjusted by shifting parallel to the base wall, so that the chamber cover portion covers a bigger or smaller part of the inlet opening.

* * * * *